US007049501B2

(12) United States Patent
Shellhammer et al.

(10) Patent No.: US 7,049,501 B2
(45) Date of Patent: May 23, 2006

(54) RING MUTE

(76) Inventors: Mark Matthew Shellhammer, 135 Hall St., Clarksburg, WV (US) 26301; Ellen Jane Shellhammer, 135 Hall St., Clarksburg, WV (US) 26301

( * ) Notice: Subject to any disclaimer, the term of this patent is extended or adjusted under 35 U.S.C. 154(b) by 25 days.

(21) Appl. No.: 10/601,536

(22) Filed: Jun. 24, 2003

(65) Prior Publication Data

US 2004/0261602 A1 Dec. 30, 2004

(51) Int. Cl.
*G10D 9/06* (2006.01)

(52) U.S. Cl. ..... 84/400; 181/233

(58) Field of Classification Search ..... 84/400, 84/207, 256; 181/233, 150
See application file for complete search history.

(56) References Cited

U.S. PATENT DOCUMENTS

| | | | | |
|---|---|---|---|---|
| 1,508,024 | A * | 9/1924 | McArthur | 84/400 |
| 4,121,686 | A * | 10/1978 | Keller, Jr. | 181/233 |
| 4,998,959 | A * | 3/1991 | Purdie | 84/400 |
| 5,373,771 | A * | 12/1994 | Weik et al. | 84/400 |
| 6,114,619 | A * | 9/2000 | Thompson | 84/400 |
| 6,843,345 | B1 * | 1/2005 | Koizumi et al. | 181/150 |

* cited by examiner

*Primary Examiner*—David Martin
*Assistant Examiner*—Jianchun Qin

(57) ABSTRACT

The present invention (ring mute) is a device comprised of a sound absorbent foam urethane ring with an incision encircling the inner section of the ring with an adhesive strip encircling the outer section of the ring to protect the foam ring from damage. The ring mute is designed to fit onto and around the rim of the bell of a brass musical instrument. The rim of the bell fits into the incision located in the inner section of the foam ring. The purpose of the ring mute is to dampen the sound of a brass musical instrument.

3 Claims, 4 Drawing Sheets

RING MUTE

CROSS-REFERENCE TO RELATED APPLICATIONS

Below are the references. No references were originally submitted.

REFERENCES CITED

U.S. Patent Documents

| | | | |
|---|---|---|---|
| D69112 | DECEMBER, 1925 | BUSKEY | 84/400 |
| 1508024 | SEPTEMBER, 1924 | MCARTHUR | 84/400 |
| 1644272 | OCTOBER, 1927 | PINARD | 84/400 |
| 1741835 | DECEMBER, 1929 | GANTNER | 84/453 |
| 2657609 | NOVEMBER, 1953 | STROBACH | 84/453 |
| 3016782 | JANUARY, 1962 | LAAS | 84/800 |
| 3099183 | JULY, 1963 | ALLES | 84/400 |
| 3299764 | JANUARY, 1967 | VENTURA | 84/400 |
| 3760679 | SEPTEMBER, 1973 | GOSSICK, ET AL | 84/400 |
| 4012983 | MARCH, 1977 | PLOEGER | 84/400 |
| 4632003 | DECEMBER, 1986 | KOPP | 84/400 |

Foreign Patent Documents

| | | | |
|---|---|---|---|
| 374187 | APRIL, 1923 | DD | 84/400 |

STATEMENT REGARDING FEDERALLY SPONSORED RESEARCH OR DEVELOPMENT

Not Applicable

INCORPORATION BY REFERENCE OF MATERIAL SUBMITTED ON A COMPACT DISC OR REFERENCE TO A MICROFICHE APPENDIX

Not Applicable

BACKGROUND OF THE INVENTION (1) Field of the Invention

The invention of this application (ring mute) relates to brass musical instruments with a brass bell. Particularly, this invention dampens the sound of a brass musical instrument by placing a sound absorbent foam urethane ring onto and around the rim of the bell of a brass musical instrument.

The invention is comprised of a flexible foam urethane ring with an incision 0.25 inches deep extending the entire inner circumference of the invention. The foam ring is held onto the rim of the bell of the brass musical instrument by placing the rim into an incision located in the inner area of the ring.

According to R. Morley-Pegge, The French Horn (London), 1960, p. 139., there is no record of the first use of the mute for horn, or for that matter any other brass instrument. For the horn, the first usage is said to have been well before 1750.

An early example is found in *Buxtehunde Cantata*, Ihr lieben Christen, freut euch nuin, which calls for two Clarini in Sordini.

According to Yasir Agha of Jazz Review.com, Joe King Oliver having joined Kid Ory's Brownskin Babies in about 1914 or 1915 was known for developing great expressive skills in the use of mutes.

Mutes for brass musical instruments come in various sizes and shapes. Some examples are found in U.S. Pat. No. 5,373,771; U.S. Pat. No. 3,760,679; U.S. Pat. No. 4,998,959; U.S. Pat. No. 1,508,024; U.S. Pat. No. 3,299,764; and U.S. Pat. No. 3,099,183.

(2) Description of Related Art Including Information Disclosed Under 37 CFR 1.97 and 1.98

Other typically utilized mutes that attach to the bell of a brass instrument can be found in U.S. Pat. No. 5,373,771; U.S. Pat. No. 3,760,679; and U.S. Pat. No. 4,998,959. Yet none of these mutes use a foam ring that is placed onto and around the rim of the bell of a brass musical instrument for the sole purpose of dampening the sound.

A mute is a device that softens or muffles the sound of an instrument (Hal Leonard Music Dictionary ISBN 0-7935-1654-4). Heretofore, all mutes either soften or muffle an instrument, yet, the ring mute does not fit into the bell or employ metal clips or fasteners to secure the mute onto the bell of the instrument.

BRIEF SUMMARY OF THE INVENTION

The present invention suggests a mute for a brass musical instrument which has a bell. One aspect of the present invention (ring mute), is that it is not comprised of a hollow body like found in U.S. Pat. No. 1,508,024. A further aspect of the present invention is that it does not fit into the throat of the of the brass musical instrument as in U.S. Pat. No. 1,741,835.

A similar aspect to other mutes is that the invention does fit onto the rim of a brass musical instrument yet is not held or reinforced by metal clamps, clips, or wires like those found in U.S. Pat. No. 5,373,771; U.S. Pat. No. 3,760,679; and U.S. Pat. No. 4,998,959.

The present invention provides a benefit by dampening the sound of the brass musical instrument by placing a flexible foam urethane ring onto and around the rim of the bell of the brass musical instrument. The ring is held onto the rim of the bell of the brass musical instrument by placing the rim of the bell of the brass musical instrument inside an incision 0.25 inches deep that encircles the entire inner area of the foam ring.

Another advantage of the present invention is that since there is no hollow body type mute as with U.S. Pat. No. 1,508,024, the sound of a hollow body mute is not heard.

Other benefits and advantages of the present invention will become apparent to those skilled in following the descriptive application of the invention.

BRIEF DESCRIPTION OF THE SEVERAL VIEWS OF THE DRAWING(S)

In drawings forming a portion of the disclosure of this invention:

DETAILED DESCRIPTION OF THE INVENTION

The present invention is a non adjustable, non resonating device for dampening the sound of a brass musical instrument by the use of a sound absorbing, open cell, flexible, urethane foam, which is formed into a ring and placed on the bell rim of a brass musical instrument without the use of screws or wires for attachment.

Figure 1:
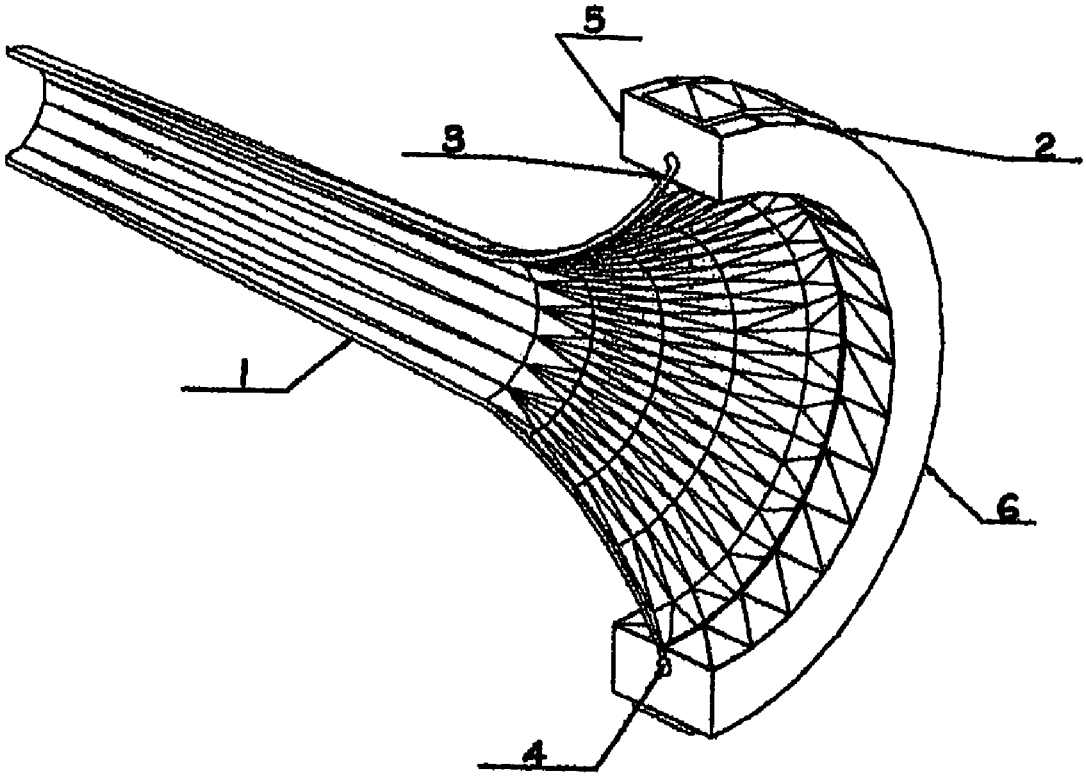
FIG. 1 is a cut away view of the present invention attached to the bell rim of a brass musical instrument.
Figure 2:
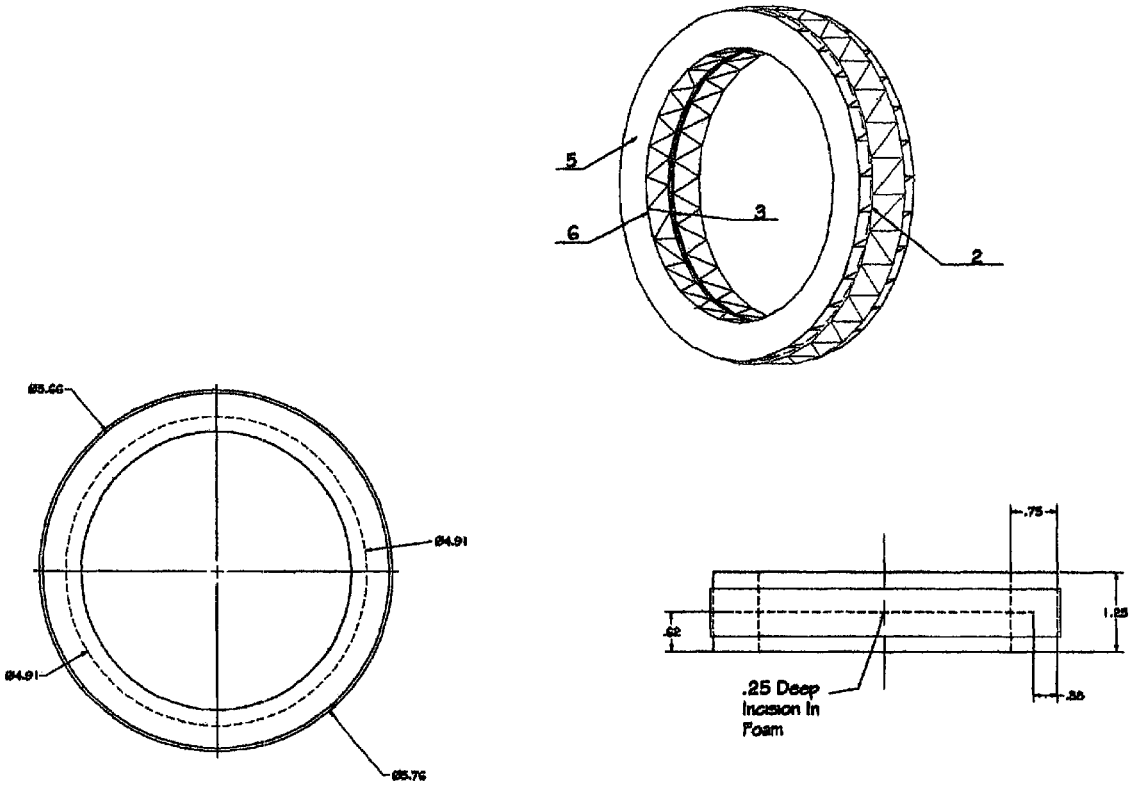
FIG. 2 is a three part view showing the dimensions of the present invention without a brass musical instrument.
Figure 3:
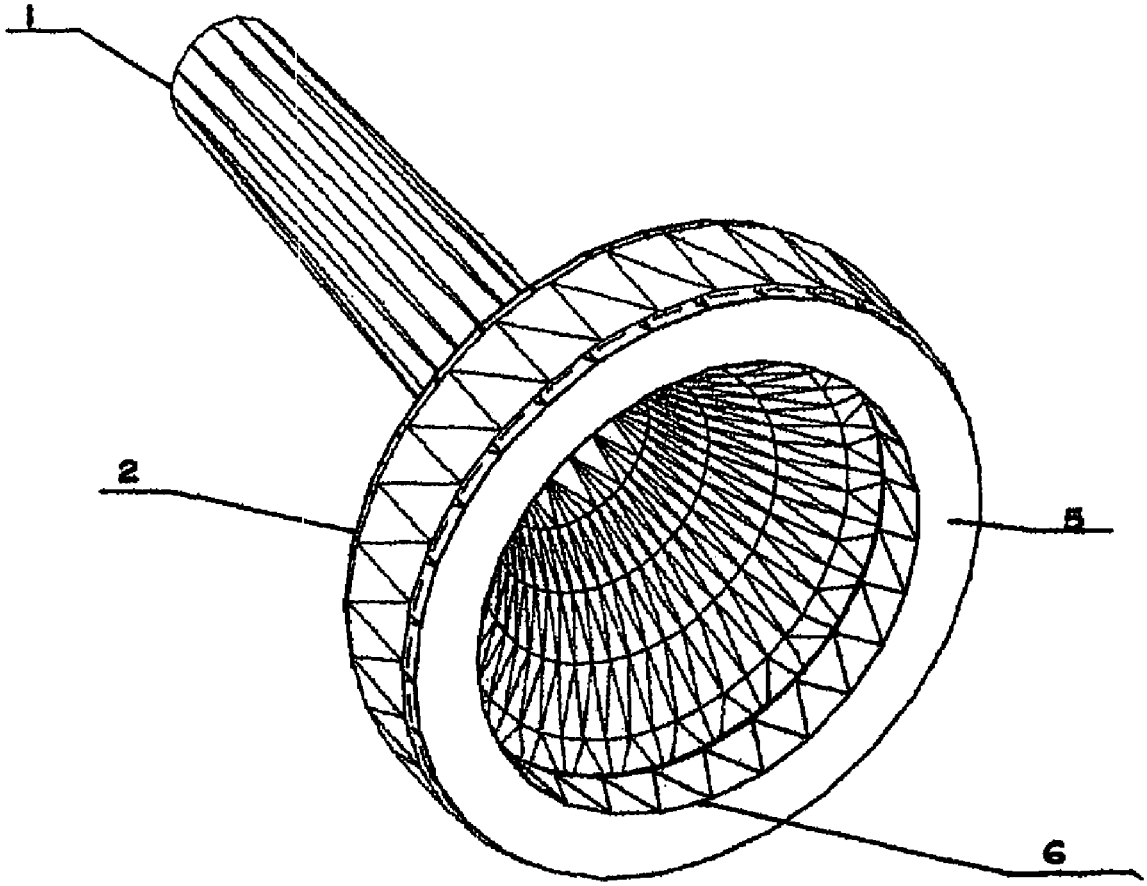
FIG. 3 is an angled frontal view of the present invention attached to the bell rim of a brass musical instrument.
Figure 4:
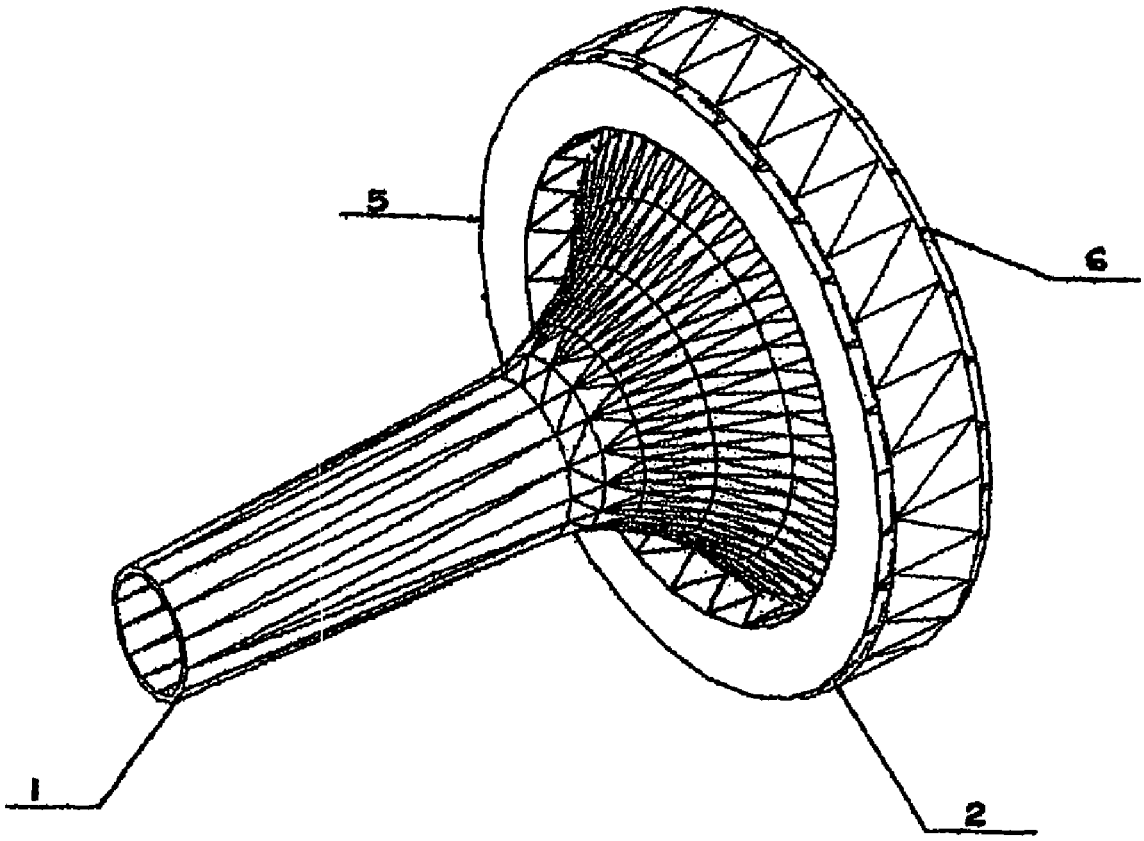
FIG. 4 is an angled rear view of the present invention attached to the bell rim of a brass musical instrument.

With references to FIGS. 1 through 4, the present invention is shown. The present invention 6 is shown with the urethane foam body 5 with an incision 3 fitted onto the bell rim 4 of a brass musical instrument 1. Protective adhesive tape 2 is shown encircling the outer portion of the urethane foam body 5.

Mute 6 is shown from three different angles without the brass musical instrument 1 showing the 0.25 inch deep incision 3 and the 0.625 inch by 1.25 inch dimensions of the open cell urethane foam body 5 and the 1 inch wide protective adhesive tape 2 with the thickness of 9 mils.

Mute 6 is shown from a frontal angle placed on a brass musical instrument 1. From this angle, the urethane body 5 and the protective adhesive tape 2 are shown.

Mute 6 is shown from a rear angle placed on a brass musical instrument 1. From this angle the urethane body 5 and the protective adhesive tape 2 are shown.

Thus, it is amply demonstrated that the present invention is not comprised of a resonating body nor does it require screws or wires for attachment onto the bell rim of a brass musical instrument. Instead, the present invention is comprised of a sound absorbing or dampening material (As defined by American National Standards Institute (ANSI) S1.1-1994 Acoustical Terminology) shaped into a ring and placed onto the bell rim of a brass musical instrument. By the use of a non adjustable sound proofing ring made of flexible, open cell, urethane foam (Which by definition is commonly used for sound proofing. ChemIndustry.Com) placed on the bell rim of a brass musical instrument, the sound of the brass musical instrument is dampened. Also, bell design will vary greatly from one type of brass musical instrument to a different type of brass musical instrument, for example the difference between a trombone and a tuba. This will require the dimensions of the present invention to vary in accordance with the instrument to which it is being applied. In addition, bell design can vary from trumpet to trumpet (A Quick Look At Bell Vibrations, IGT, October 2001) requiring possible variations in the present invention. However, the variations in foam ring dimension and the type of sound absorbing foam used will not result in any loss in the spirit or intent of the present invention to absorb the sound of a brass musical instrument. Thus, the amount of sound that is absorbed or dampened is dependent on the dimensions and the type of foam used (American Micro Industries, Inc.).

SEQUENCE LISTING

Not applicable

What is claimed is:

1. The ring mute is a mute that attaches onto and around the rim of the bell of a brass musical instrument, comprising: a sound dampening absorbent flexible foam material with an adhesive strip attached to the outer surface of the ring; and a scalpel incision on the inside middle of the ring extending the entire middle circumference of the inner area of the ring.

2. The ring mute as set forth in claim 1, is a sound absorbent flexible urethane foam material ring 1.25 inches wide and 0.625 inches thick with a 0.25 deep scalpel incision extending the entire middle circumference of the inner area of the ring.

3. The ring mute as set forth in claim 1, possesses a flexible, non-porous adhesive strip 1 inch wide attached to the outer area of the ring encircling the outer area of the ring.

* * * * *